US008534349B2

(12) United States Patent
Nishikawa et al.

(10) Patent No.: US 8,534,349 B2
(45) Date of Patent: Sep. 17, 2013

(54) HEAT EXCHANGER TUBE AND HEAT EXCHANGER

(75) Inventors: Naoki Nishikawa, Oyami (JP); Koichiro Take, Oyami (JP); Noboru Ogasawara, Oyama (JP)

(73) Assignee: Keihin Thermal Technology Corporation, Oyama-shi (JP)

( * ) Notice: Subject to any disclaimer, the term of this patent is extended or adjusted under 35 U.S.C. 154(b) by 2710 days.

(21) Appl. No.: 10/432,439

(22) PCT Filed: Nov. 22, 2001

(86) PCT No.: PCT/JP01/10240

§ 371 (c)(1),
(2), (4) Date: Oct. 29, 2003

(87) PCT Pub. No.: WO02/42706

PCT Pub. Date: May 30, 2002

(65) Prior Publication Data

US 2004/0069477 A1 Apr. 15, 2004

(30) Foreign Application Priority Data

Nov. 24, 2000 (JP) ..... 2000-356968

(51) Int. Cl.
*F28F 1/40* (2006.01)

(52) U.S. Cl.
USPC ..... 165/183; 165/153; 165/179

(58) Field of Classification Search
USPC ..... 165/148, 152, 153, 179, 181, 183
See application file for complete search history.

(56) References Cited

U.S. PATENT DOCUMENTS 5,476,141 A 12/1995 Tanaka

FOREIGN PATENT DOCUMENTS

| | | | |
|---|---|---|---|
| DE | 43 25 043 A1 | | 1/1994 |
| GB | 2 284 471 | * | 7/1995 |
| JP | 6-142755 | | 5/1994 |
| JP | 6-300473 | | 10/1994 |
| JP | 2000-11290 | | 4/2000 |
| JP | 2000-154987 | | 6/2000 |
| JP | 2000-356488 | | 12/2000 |
| JP | 2001-194081 | | 7/2001 |

OTHER PUBLICATIONS

J. Pettersen et al.: "Development of compact heat exchangers for CO2 air-conditioning systems" International Journal of Refrigeration, vol. 21, No. 3, pp. 180-193 1998.

* cited by examiner

*Primary Examiner* — Teresa Walberg
(74) *Attorney, Agent, or Firm* — Oblon, Spivak, McClelland, Maier & Neustadt, L.L.P.

(57) ABSTRACT

A heat exchanger tube (1), wherein a plurality of refrigerant passages (5) extending in the longitudinal direction of the tube are formed in a flat tube body (2) with a specified length parallel with each other in the lateral direction of the tube and, where the overall cross sectional area of the tube body (2) is (At), the overall cross sectional area of the refrigerant passage (5) is (Ac), the outer peripheral length of the tube body (2) is (L), and the overall inner peripheral length of the refrigerant passage (5) is (P), set so that the relation of Ac/At×100=30 to 55 and P/L×100=150 to 325 can be established, whereby a heat exchanging performance can be increased.

5 Claims, 11 Drawing Sheets

HEAT EXCHANGER TUBE AND HEAT EXCHANGER

TECHNICAL FIELD

The present invention relates to a heat exchanger such as a condenser for use in a refrigeration cycle for car air-conditioners, household air-conditioners or cooling devices for electronics devices and a heat exchanger tube to be applied to such a heat exchanger.

BACKGROUND ART

Conventionally, as a condenser for use in a refrigeration cycle of car air-conditioners, a heat exchanger 50 as shown in FIGS. 16 and 17 is widely employed.

This heat exchanger 50 includes a pair of vertically disposed headers 52 and 52, a plurality of heat exchanger tubes 53 disposed in parallel each other with the opposite ends communicated with the headers 52 and 52, fins 54 disposed between the adjacent tubes 53 and at the outside of the outermost tube 53 and side plates 55 disposed at the outside of the outermost fin 54. The heat exchanger tubes 53 are grouped into a plurality of passes C1 to C3 by partitioning members 56 provided in the headers 52 and 52. A gaseous refrigerant introduced via the refrigerant inlet 57 provided at the upper portion of one of the headers 52 passes through each of the passes C1 to C3 in turn, and is condensed by exchanging heat with the ambient air while passing through the passes. The condensed refrigerant flows out through the refrigerant outlet 58 provided at the lower portion of the other header 52.

As a tube 53 used for such a heat exchanger 50, an aluminum extruded tube of a flat shape having a thickness smaller than a width and a plurality of refrigerant flow passages 53*a* each having a rectangular cross-sectional shape and extending in the tube longitudinal direction is widely used.

The aforementioned heat exchanger 50 is usually installed in a vehicle such as a car or a truck. In recent years, such a vehicle is required to be small in size and light in weight for the purpose of increasing the fuel economy, decreasing the harmful emission gas ($CO_2$, $NO_x$), decreasing the amount of refrigerant. Accordingly, all of the automobile parts are also required to be high in performance as well as small in size and light in weight. This requirement is also applied to the heat exchanger 50 without exception.

In order to decrease the weight of the heat exchanger tube 53, it is considered to decrease the tube height or the thickness of the peripheral wall of the tube 53.

However, the passage cross-sectional area of the refrigerant flow passage 53*a* decreases as the tube height decreases, causing increased passage flow resistance and increased pressure loss, which in turn may sometimes cause deterioration of the condenser performance.

Further, if the thickness of the exterior peripheral wall of the tube 53 is simply formed into a thin wall, the pressure resistance deteriorates and it becomes difficult to form an enough sacrifice corrosion resistance layer, which in turn causes deterioration of corrosion resistance.

The present invention aims to solve the aforementioned prior art problems and provide a heat exchanger tube and a heat exchanger capable of improving the heat exchanging performance while decreasing the size and weight.

Another objects of the present invention will be apparent from the following explanation.

DISCLOSURE OF INVENTION

The inventors have analyzed a structure of a heat exchanger such as a condenser, especially a heat exchanger tube adapted to such a heat exchanger, from all angles in detail, and then repeatedly performed detailed experiments/studies based on the analyzed results. As a result, they have found the optimal conditions of a heat exchanger and its tube capable of attaining the aforementioned objects, and completed the present invention.

According to the first invention, a heat exchanger tube is provided with a flat tube main body with a certain length having a plurality of refrigerant flow passages each extending in a tube longitudinal direction and disposed in parallel with each other in a tube widthwise direction, wherein the following relations are established:

$$Ac/At \times 100 = 30 \text{ to } 55; \text{ and}$$

$$P/L \times 100 = 150 \text{ to } 325,$$

wherein a total cross-sectional area of the tube main body (including the refrigerant flow passage portion) is "At", a total cross-sectional area of the refrigerant flow passages is "Ac", an external peripheral length of the tube main body is "L", and a total internal peripheral length of the refrigerant flow passages is "P".

An example of the structure of the heat exchanger tube according to the present invention will be explained in detail with reference to the drawings. As shown in FIGS. 1 and 2, the heat exchanger tube 1 according to the present invention is used as a heat exchanger tube for a heat exchanger which is similar to a conventional multi-flow type heat exchanger as shown in FIGS. 16 and 17, and is constituted by an elongated aluminum extruded article or the like.

This heat exchanger tube 1 has a flat tube main body 2 having the height H smaller than the width W.

The tube main body 2 is provided with a plurality of refrigerant flow passages 5 rectangular in cross-section extending in the tube longitudinal direction and arranged in the tube widthwise direction.

Here, as mentioned above, in the heat exchanger tube 1 according to the present invention, it is necessary to set "Ac/At×100" and "P/L×100" to be "30 to 55" and "150 to 325", respectively, as shown in FIG. 5, wherein the total cross-sectional area of the tube main body 2 (including the refrigerant flow passage portions) is "At"; the total cross-sectional area of the refrigerant flow passages is "Ac"; the external peripheral length of the tube main body 2 is "L"; and the total internal peripheral length of the refrigerant flow passages 5 is "P".

That is, in cases where Ac/At is less than 30%, the refrigerant flow resistance and the pressure loss increase, which may cause an increased tube weight. To the contrary, in cases where Ac/At exceeds 55%, the flow passage cross-sectional area increases, the flow velocity of the refrigerant in the tube decreases and the heat transfer rate deteriorates. In cases where Ac/At is not larger than 55%, even if the flow velocity in the tube is low, excellent heat performance can be obtained by keeping enough tube interior peripheral length "P".

Furthermore, in cases where P/L is less than 150%, the heat transfer performance deteriorates, resulting in insufficient heat performance as a heat exchanger. In other words, in cases where P/L is 150% or more, if Ac/At is less than 30%, the refrigerant pressure loss increases remarkably. However, this increase of refrigerant pressure loss can be suppressed by setting Ac/At to be 30% or more.

Furthermore, if P/L is larger than 325%, in case of an aluminum extruded tube, the extrusion die becomes a minute configuration, which may cause a problem in manufacturing the tube. Even if a three-dimensional configuration processing method or a method of forming communication apertures (refrigerant flow passages) by roll forming is employed, the die becomes a minute configuration, which also may cause a problem in manufacturing the tube.

Furthermore, in the first invention, in order to obtain the aforementioned characteristics, it is preferable to employ the following structure.

That is, in the first invention, it is preferable to employ the structure in which Ac/At is set to be 45% or less and P/L is set to be 200% or more. Furthermore, it is more preferable to employ the structure in which Ac/At is set to be 35% or more and 40% or less and P/L is set to be 250% or more.

The specific range of the aforementioned numerals can be obtained from the graphs shown in FIGS. 6 and 7. That is, the graph shown in FIG. 6 shows the relation between the "Ac/At" and the heat transfer quantity "Q" in a tube 1 having a specific "P/L" in a multi-flow type condenser. FIG. 7 is a graph with hatched lines showing the range in which enough heat transfer quantity "Q" can be obtained based on the graph shown in FIG. 6.

As will be apparent from these graphs, in cases where Ac/At and P/L fall within the aforementioned essential range or preferable range, the heat transfer quantity Q is large, which reveals that the tube falling within the range shown in FIG. 5 has excellent heat exchanging performance.

On the other hand, in the first invention, it is preferable to employ the structure in which the following relation is established: H=0.5 to 1.5 mm, wherein the height H of the tube main body 2 is "H".

That is, as shown in FIGS. 2 and 3, if the tube height H is set to be 1.5 mm or more, it becomes difficult to decrease the weight because of the increased size. To the contrary, if the tube height H is set to be less than 0.5 mm, it becomes difficult to keep enough height of the refrigerant flow passage 5, causing a short total peripheral length P of the flow passage. When the tube height H is set to be less than 0.5 mm by decreasing the thickness of the external peripheral wall of the tube main body 2 to increase the size of the refrigerant flow passage 5, there are possibilities that the pressure resistance of the external peripheral wall deteriorates or the corrosion resistance deteriorates by failing to form a sacrifice corrosion layer on the external peripheral wall.

Furthermore, in the first invention, it is preferable to employ the structure in which the relation of W=10 to 20 mm is established, wherein the width of the aforementioned tube main body is "W".

That is, if the width "W" of the tube main body 2 is too large, the size of the apparatus becomes large. To the contrary, if the width "W" is too small, there is a fear that it becomes difficult to keep enough heat transferring characteristic.

Furthermore, in the present invention, in the refrigerant flow passage 5 formed in the tube, the heat transfer characteristic can be increased as the interior peripheral length P increases and the passage flow resistance can be decreased as the cross-sectional increases. Accordingly, it is preferable to form the cross-sectional configuration of the refrigerant flow passage 5 not into a circular shape but into a rectangular shape (quadrangular shape) in order to increase the interior peripheral length "P" and the cross-sectional area.

As mentioned above, in the present invention, it is necessary to set the total interior peripheral length of the refrigerant flow passages to the total tube peripheral length "P/L" to be larger than a specific value as mentioned above.

In order to increase "P/L" or to set "P/L" to be 150% or more, it is considered to employ a method for increasing the number of refrigerant flow passages 5 to the unit tube width "N/W" and a method for forming protruded micro fins 5*a* on the interior surface of the refrigerant flow pass 5 as shown in FIGS. 8A to 8C without increasing the number of refrigerant flow passages.

FIG. 8A shows an embodiment in which each refrigerant flow passage 5 is integrally provided with a total of two micro fins 5*a*, one on the upper wall surface and one on the lower wall surface, extending in the passage longitudinal direction. FIG. 8B shows an embodiment in which each refrigerant flow passage 5 is integrally provided with a total of four micro fins 5*a*, two on the upper wall surface and two on the lower wall surface. FIG. 8C shows an embodiment in which each refrigerant flow passage 5 is integrally provided with a total of six micro fins 5*a*, three on the upper wall surface and three on the lower wall surface.

Furthermore, in the first invention, if the number of the refrigerant flow passages 5 to the tube width "N/W" decreases too much, the number of partition walls 4 decreases, which in turn may cause deterioration of the pressure resistance. Therefore, it is necessary to set "N/W" to be larger than ⅝.

That is, in the first invention, it is preferable to employ the structure in which the relation of ⅝<N/W is established, wherein the number of the aforementioned refrigerant flow passages is "N" and the tube width is "W".

Furthermore, in the first invention, although the refrigerant flow passage 5 has a rectangular cross-section as mentioned above, in cases where the passage height "H−2Tb" is very small, even if the curvature radius of the portion of the tube forming die corresponding to the corner portion of the refrigerant flow passage 5 is set to be "0 (zero)", the corner portion of the refrigerant flow passage 5 is formed into a gentle arc-shape due to the influence of the metal flow at the time of extrusion. This may sometimes cause an excessive radius "R" relative to the passage 5. Concretely, as shown in FIG. 4, in cases where the tube height "H−2Tb" is small as shown in FIG. 4, the corner portions of the upper and lower regions T1 and T3 among the trisected regions T1 to T3 of the passage height are formed into gentle arc-shape, respectively, which sometimes causes an insufficient internal peripheral length "P" or insufficient passage cross-sectional area. Accordingly, in the present invention, it is preferable that the curvature radius "R" of the corner portion of the refrigerant flow passage 5 is formed to be larger than one third (⅓) of the passage height "H−2Tb".

That is, in the first invention, it is more preferable to employ the structure in which the relation of R<(H−2Tb)×⅓ is established, wherein the curvature radius of the corner portion in the cross-section of the refrigerant flow passage is "R", the height of the aforementioned tube main body is "H" and the thickness of the external peripheral wall of the tube main body is "Tb".

Furthermore, in the first invention, it is more preferable to employ the structure in which the relation of Tb×⅛<Ta<Tb×⅔ is established, wherein the thickness of the partition wall between the adjacent refrigerant flow passages in the tube main body is "Ta", and the thickness of the external peripheral wall of the tube main body is "Tb".

That is, as shown in FIG. 3, although it is necessary to set the partition wall thickness "Ta" to be more than a certain thickness, even if the partition wall thickness "Ta" is increased more than necessary, the pressure resistance does not improve because of the following reasons. When inner pressure is applied to the refrigerant flow passage 5, if the partition wall thickness "Ta" is substantially thinner than the external peripheral wall thickness "Tb", the partition wall 4 will be destroyed. To the contrary, if the partition wall thickness "Ta" is substantially thicker than the external peripheral wall thickness "Tb", the external peripheral wall 3 will be destroyed. In view of the above information, taking into account that the maximum thickness of the sacrifice corrosion layer of the external peripheral wall 3 formed by zinc diffusion is about 33.3% (⅔) of the external peripheral wall thickness "Tb", the pressure resistance would not improve even if the relation of "Ta≧Tb×⅔" is established. Accordingly, it is preferable to set the upper limit of the partition wall thickness "Ta" to be smaller than "Tb×⅔".

Furthermore, in cases where the partition wall thickness Ta is too thin, the strength of the partition wall 4 may deteriorates, which in turn may deteriorate the pressure resistance of the tube. Therefore, it is preferable that the partition wall thickness Ta is set to be larger than one eighth (⅛) of the external peripheral wall thickness Tb.

Accordingly, in the present invention, it is preferable that the relation of "Tb×⅛<Ta<Tb×⅔" is established as mentioned above.

Furthermore, in the present invention, it is more preferable to employ the structure in which the mass velocity of the refrigerant passing through the refrigerant flow passage is set to be 50 to 800 kg/m$^2$sec.

That is, in cases where this structure is employed, the heat transfer rate can be improved, resulting in excellent heat exchanging performance.

In the present invention, it is possible to employ the structure in which the tube main body is composed of a tube external peripheral wall member constituting the external peripheral wall and an inner plate inserted in the external peripheral wall member to form refrigerant flow passages.

For example, the heat exchanger tube 11 as shown in FIGS. 9 and 10 can be preferably used. In the heat exchanger tube 11, a plurality of refrigerant flow passages 15 are provided side by side, and a plurality of communication apertures 14*c* communicating with adjacent refrigerant flow passages are formed. In this tube 11, since the refrigerant comes and goes adjacent passages freely, heat exchanging can be performed in a balanced manner in the entire tube widthwise direction, which further improves the heat exchanging performance.

Furthermore, FIG. 11 shows a heat exchanger tube 21. The tube main body 22 includes a tube external peripheral wall member 22*a* constituting the external peripheral wall and a wavy inner plate 22*b* to be inserted into the tube external peripheral wall member 22*a*. The inner plate 22*b* constitutes partition walls and inner fins and forms the refrigerant flow passages 25 within the tube.

Furthermore, in the present invention, it is possible to employ the structure in which the tube main body includes a tube upper side member constituting the upper side of the tube main body, a tube lower side member constituting the lower side thereof and a partition plate disposed between the upper and lower side members, wherein the partitioning plate partitions each refrigerant flow passage into upper and lower portions to thereby form a multi layer structure.

For example, as shown in FIG. 12, the heat exchanger tube 31 includes a tube upper side member 32*a* constituting the upper side of the tube, a tube lower side member 32*b* constituting the lower side of the tube and a partition plate 32*c* disposed between the upper and lower side members 32*a* and 32*b*. Thus, the multi-layer (two layers) refrigerant flow passages 35 each partitioned into an upper portion and a lower portion are arranged in parallel in the tube widthwise direction. It is also possible to form a refrigerant flow passage of a multi-layer structure having three or more layers by disposing two or more partition plates 32*c*.

Furthermore, in the present invention, it is also possible to employ a heat exchanger tube whose tube main body is made of a press formed article.

As shown FIG. 13, such a heat exchanger tube 41 made of a press formed article can be obtained by bending a metal plate into a flat tube shape and forming partition walls 44 forming refrigerant flow passages 45 in the tube.

In the heat exchanger tubes according to modified embodiments shown in FIGS. 9 to 13, the same or corresponding reference numerals are allotted to the same or corresponding portion of the tube shown in FIGS. 1 to 3.

On the other hand, the second invention specifies the heat exchanger such as a condenser using the heat exchanger tube of the first invention.

That is, according to the second invention, a heat exchanger includes a pair of headers disposed in parallel and a plurality of flat tubes with opposite ends thereof communicated with the headers, wherein refrigerant introduced via an refrigerant inlet of the header passes through the flat tubes while being exchanged heat and flows out of a refrigerant outlet of the header, wherein the flat tube has a flat tube main body having a predetermined length and a plurality of refrigerant flow passages each extending in the tube longitudinal direction and arranged in parallel in the tube widthwise direction, and wherein the relations of "Ac/At×100=30 to 55" and "P/L×100=150 to 325" are established, wherein the total cross-sectional area of the tube main body (including the refrigerant flow passages) is "At"; the total cross-sectional area of the refrigerant flow passages is "Ac"; the external peripheral length of the tube main body is "L" and the total peripheral length of the refrigerant flow passages is "P".

Since the heat exchanger of the second invention specifies the heat exchanger using the heat exchanger tube of the first invention, the same functions and effects as mentioned above can be obtained.

On the other hand, the present inventors eagerly conducted detailed experiences and studies based on the aforementioned first invention and further found appropriate constitutional elements.

As a result, according to the third invention, a heat exchanger tube includes a flat tube main body having a predetermined length provided with a plurality of refrigerant flow passages of a rectangular cross-section extending in the tube longitudinal direction and arranged in parallel in the tube widthwise direction, wherein the following formulas are established:

$$0.5\text{ mm}<H<1.5\text{ mm} \quad \text{(f1)}$$

$$5/8<N/W \quad \text{(f2)}$$

$$R<(H-2Tb)\times 1/3 \quad \text{(f3)}$$

$$Tb\times 1/8<Ta<Tb\times 2/3 \quad \text{(f4)}$$

wherein the height of tube main body is "H"; the width of tube main body is "W"; the number of the refrigerant flow passages is "N"; the curvature radius of the corner portion in the cross-section of the refrigerant flow passage is "R"; the thickness of the external peripheral wall of the tube main body is "Tb"; and the thickness of the partition wall between the adjacent refrigerant flow passages in the tube main body is "Ta".

These formulas (f1) to (f4) have been explained in the first invention, and the heat exchanger tube of the third invention satisfying all of these formulas (f1) to (f4) is excellent in heat exchanging performance because of the reasons mentioned above.

Furthermore, in the third invention, in order to improve the heat transfer rate, it is preferable to employ the structure in which the mass velocity of the refrigerant passing through the refrigerant flow passage is set to be 50 to 800 kg/m$^2$sec.

On the other hand, the fourth invention specifies the heat exchanger such as a condenser using the heat exchanger tube of the third invention.

That is, according to the fourth invention, a heat exchanger includes a pair of headers disposed in parallel and a plurality of flat tubes with opposite ends thereof communicated with the headers, wherein refrigerant introduced via an refrigerant inlet of the header passes through the flat tubes while being exchanged heat and flows out of a refrigerant outlet of the header, wherein the flat tube has a flat tube main body having a predetermined length and a plurality of refrigerant flow passages each extending in the tube longitudinal direction and arranged in parallel in the tube widthwise direction, and wherein the following formulas are established:

$$0.5\text{ mm}<H<1.5\text{ mm} \quad \text{(f1)}$$

$$5/8<N/W \quad \text{(f2)}$$

$$R<(H-2Tb)\times 1/3 \quad \text{(f3)}$$

$$Tb\times 1/8<Ta<Tb\times 2/3 \quad \text{(f4)}$$

wherein the height of tube main body is "H"; the width of tube main body is "W"; the number of the refrigerant flow passages is "N"; the curvature radius of the corner portion in the cross-section of the refrigerant flow passage is "R"; the thickness of the external peripheral wall of the tube main body is "Tb"; and the thickness of the partition wall between the adjacent refrigerant flow passages in the tube main body is "Ta".

Since this fourth invention specifies the heat exchanger using the heat exchanger tubes of the third invention, the same functions and effects as mentioned above can be obtained.

Furthermore, in the fourth invention, in order to improve the heat transfer rate, it is preferable to employ the structure in which the mass velocity of the refrigerant passing through the refrigerant flow passage is set to be 50 to 800 kg/m$^2$sec.

BEST MODE FOR CARRYING OUT THE INVENTION

EXAMPLES

Figure 1:
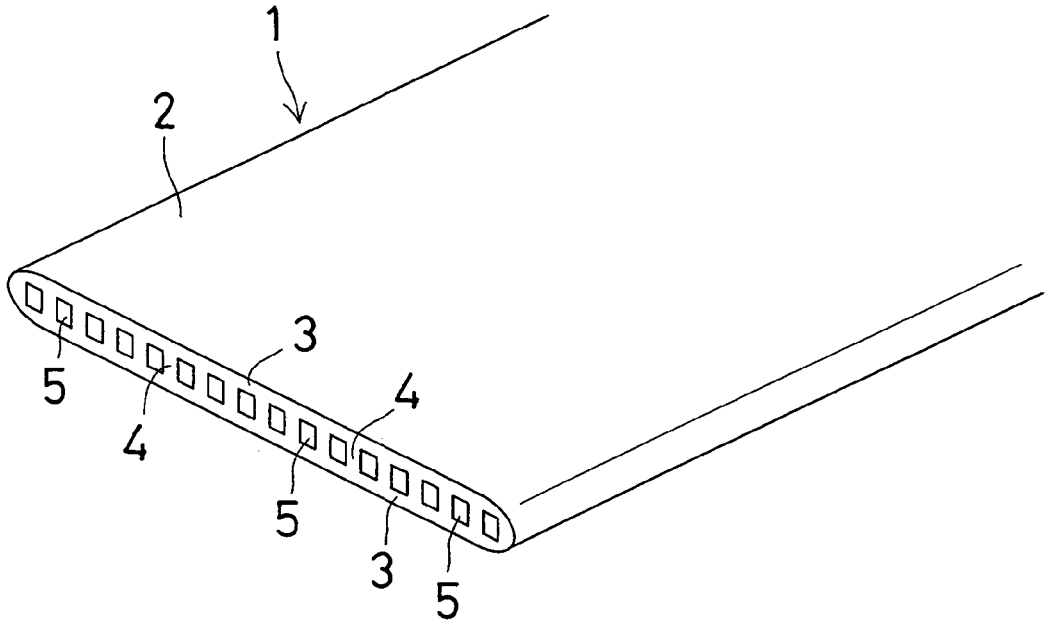
FIG. 1 is a perspective view showing the heat exchanger tube related to the invention.
Figure 2:
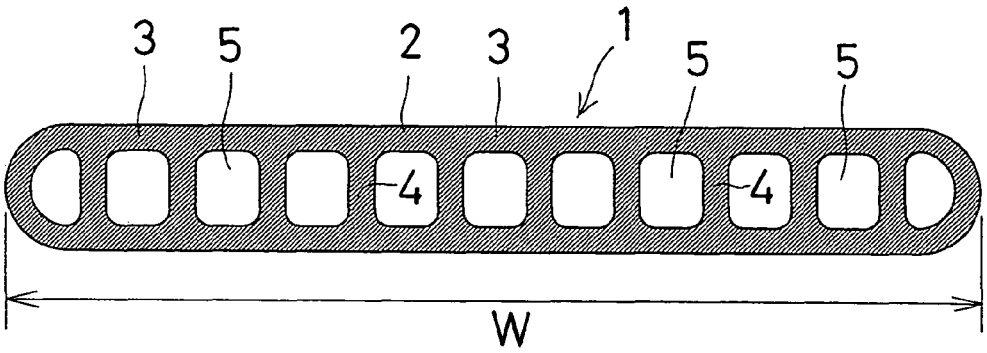
FIG. 2 is a cross-sectional view showing the heat exchanger tube related to the invention.
Figure 3:
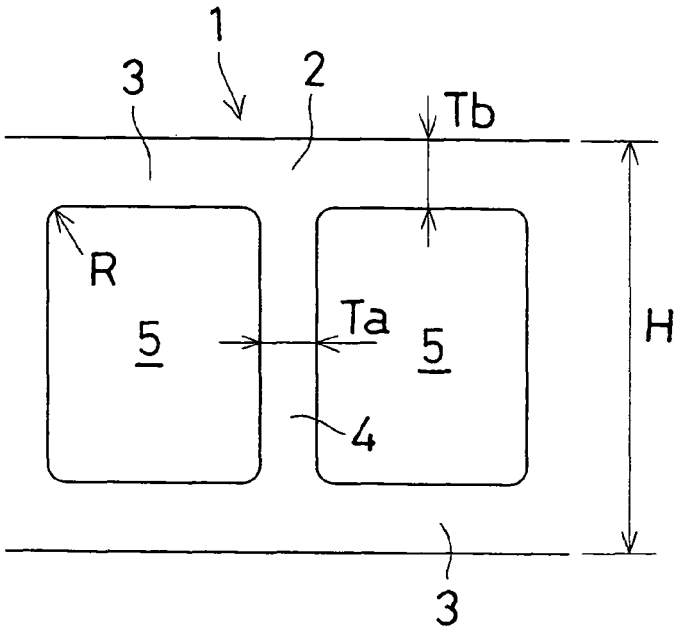
FIG. 3 is an enlarged cross-sectional view showing the refrigerant flow passage and its vicinity of the heat exchanger tube related to the invention.
Figure 4:
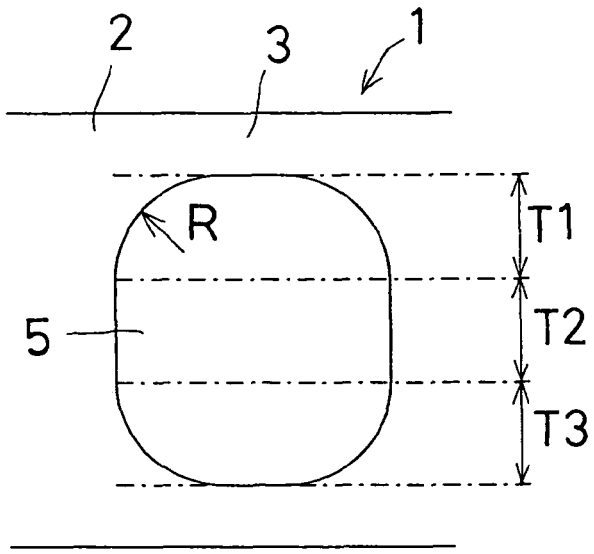
FIG. 4 is an enlarged cross-sectional view showing the refrigerant flow passage and its vicinity of a preferable embodiment of the heat exchanger tube according to the invention.
Figure 5:
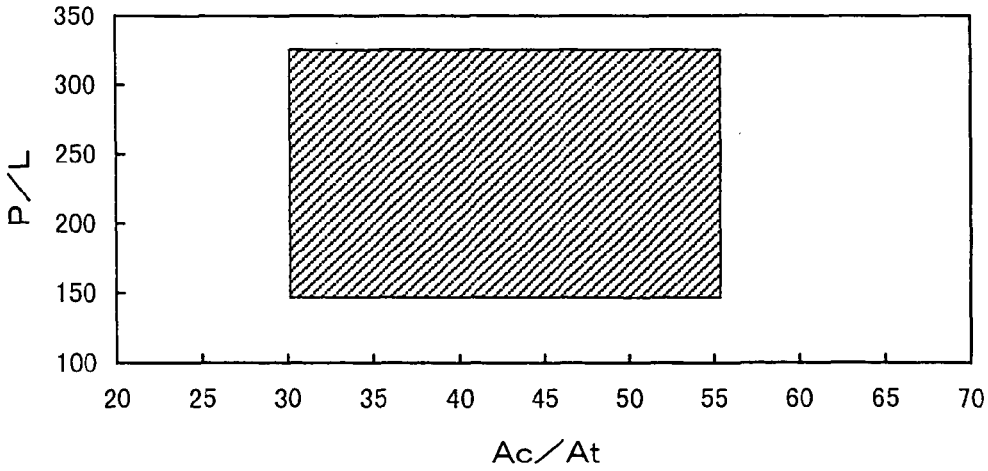
FIG. 5 is a graph showing the relation between Ac/At and P/L in a heat exchanger tube of a multi-flow condenser.
Figure 6:
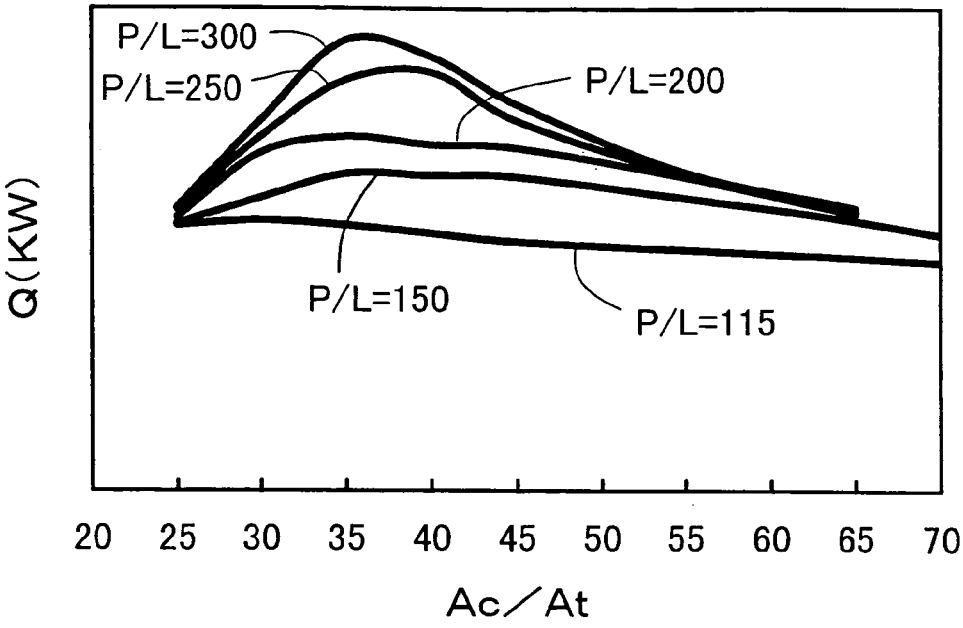
FIG. 6 is a graph showing the relation between Ac/At and the heat transfer quantity in the heat exchanger tube.
Figure 7:
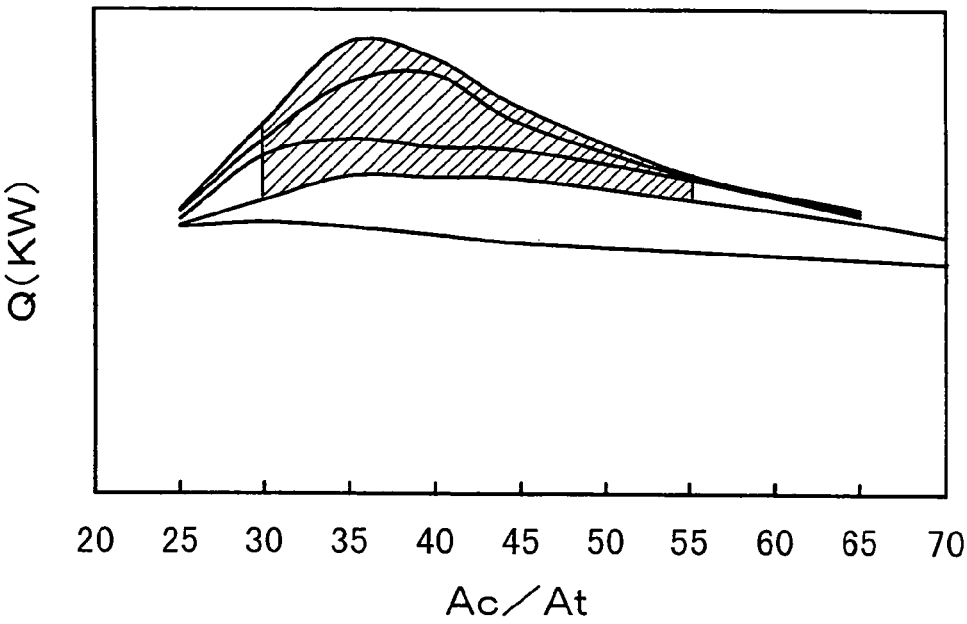
FIG. 7 is a graph showing the applicable range of Ac/At and P/L in the heat exchanger tube according to the invention.
Figure 8A:
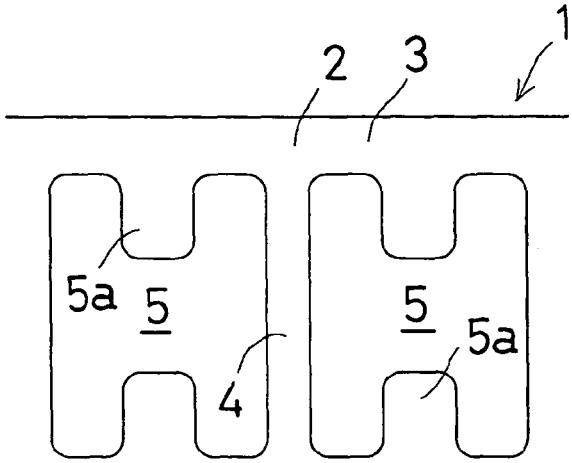
FIG. 8A is an enlarged cross-sectional view showing the refrigerant flow passage and its vicinity of the heat exchanger tube of the first modification of the invention.
Figure 8B:
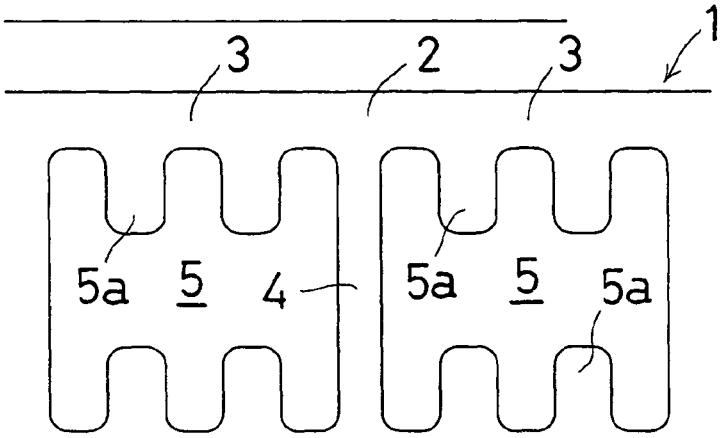
FIG. 8B is an enlarged cross-sectional view showing the refrigerant flow passage and its vicinity of the heat exchanger tube of the second modification of the invention.
Figure 8C:
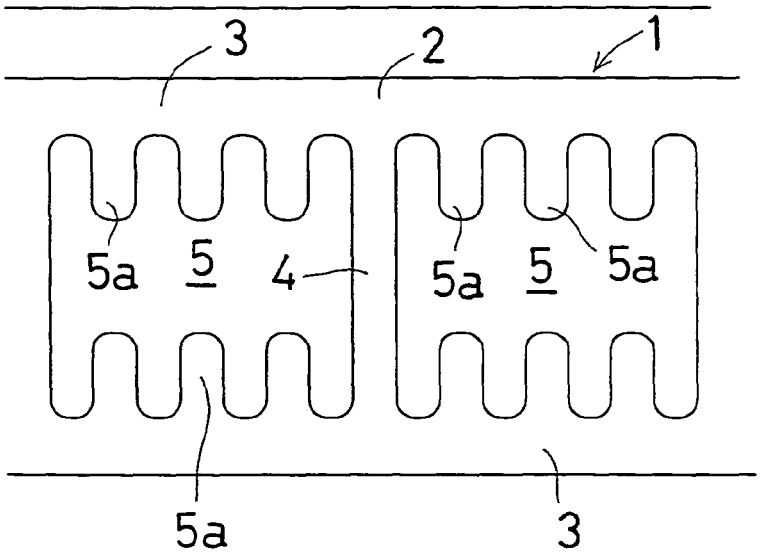
FIG. 8C is an enlarged cross-sectional view showing the refrigerant flow passage and its vicinity of the heat exchanger tube of the third modification of the invention.
Figure 9:
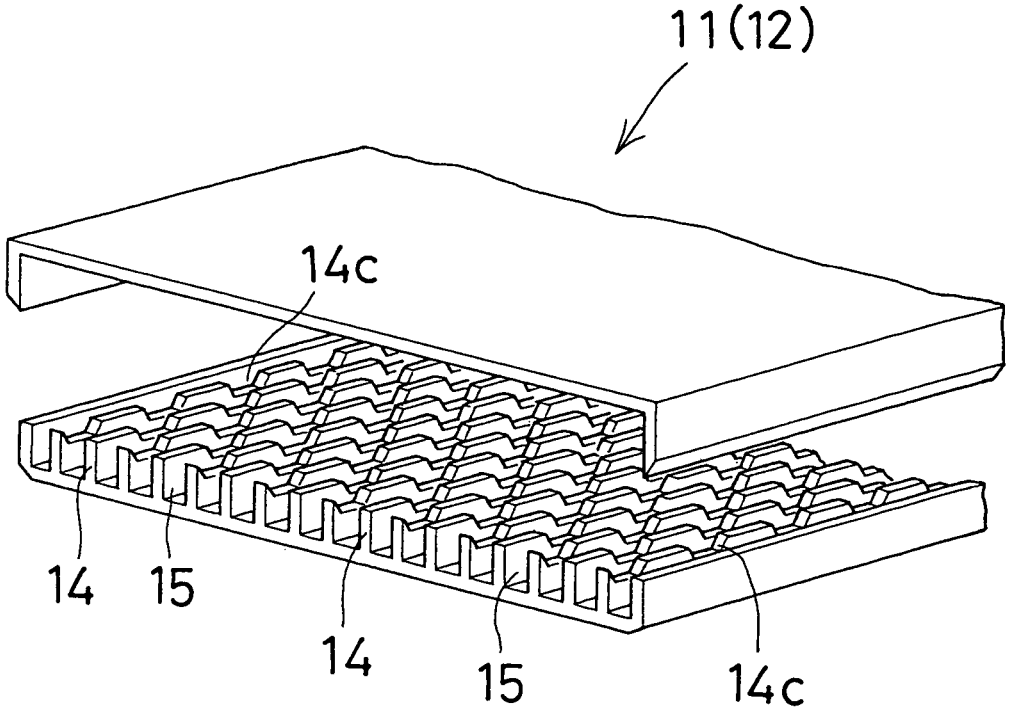
FIG. 9 is an exploded perspective view showing the heat exchanger tube of the fourth modification of the invention.
Figure 10A:
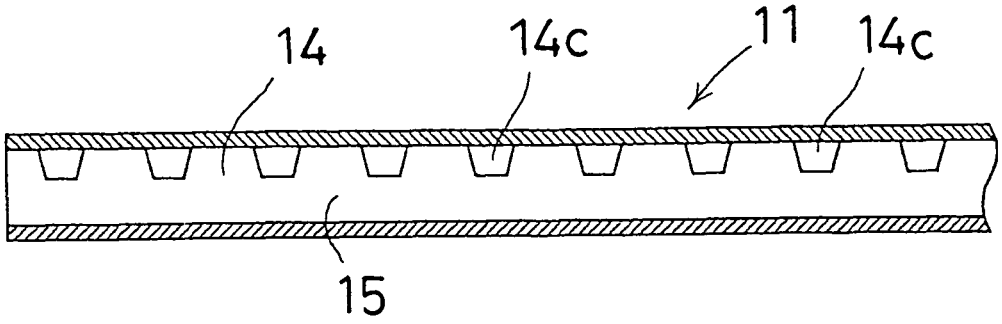
FIG. 10A is a side cross-sectional view showing the heat exchanger tube of the fourth modification of the invention.
Figure 10B:
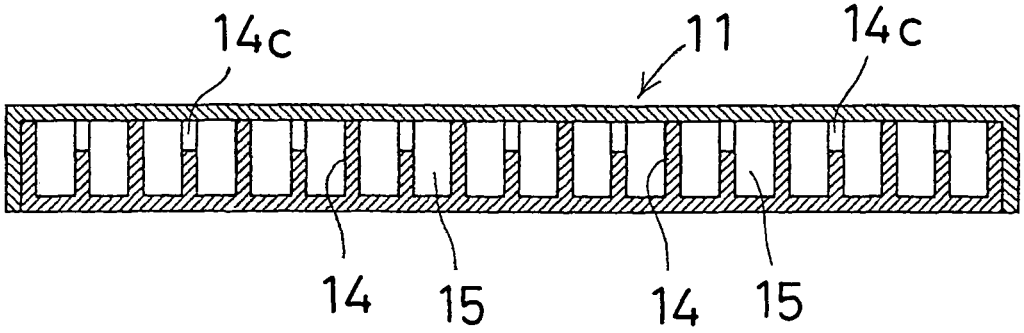
FIG. 10B is a front cross-sectional view showing the heat exchanger tube of the fourth modification of the invention.
Figure 11:
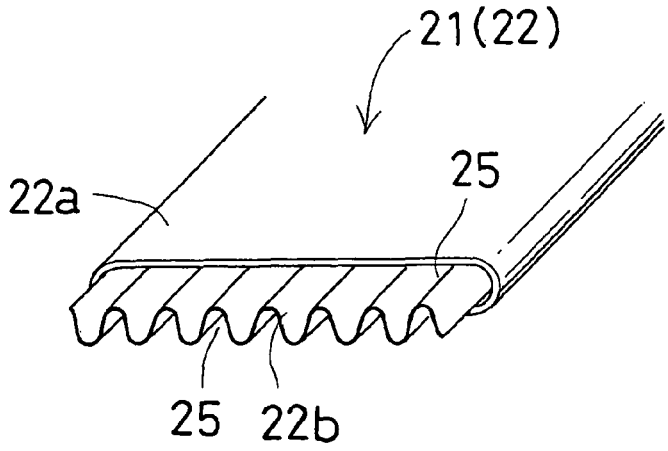
FIG. 11 is a perspective view showing the heat exchanger tube of the fifth modification of the invention.
Figure 12:
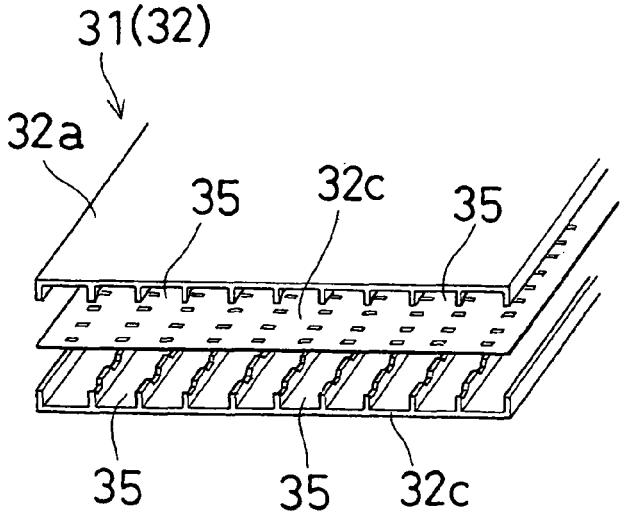
FIG. 12 is an exploded perspective view showing the heat exchanger tube of the sixth modification of the invention.
Figure 13:
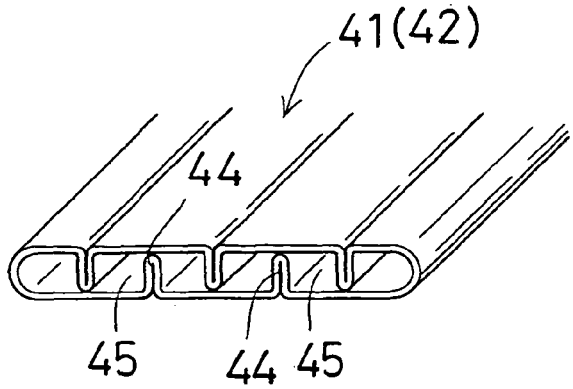
FIG. 13 is a perspective view showing the heat exchanger tube of the seventh modification of the invention.

Hereinafter, examples and comparative examples related to the invention will be detailed.

TABLE 1

| | Ac (mm$^2$) | At (mm$^2$) | P (mm) | L (mm) | Ac/At (%) | P/L (%) | N (number) | H (mm) | W (mm) | Q (kW) | P/W | N/W | Ta (mm) | Tb (mm) | R (mm) | ha (kW/K) |
|---|---|---|---|---|---|---|---|---|---|---|---|---|---|---|---|---|
| Example | | | | | | | | | | | | | | | | |
| 1 | 6.5 | 18.1 | 104 | 32.1 | 35.8 | 325 | 35 | 1.15 | 16 | 10.8 | 6.5 | 2.18 | 0.06 | 0.25 | 0.05 | 0.98 |
| 2 | 8 | 18.1 | 71 | 32.1 | 44.2 | 223 | 20 | 1.15 | 16 | 10.1 | 4.46 | 1.25 | 0.06 | 0.25 | 0.05 | 0.52 |
| 3 | 8.8 | 18.1 | 53 | 32.1 | 48.6 | 166 | 12 | 1.15 | 16 | 10 | 3.32 | 0.75 | 0.06 | 0.25 | 0.05 | 0.3 |
| 4 | 6.5 | 18.1 | 104 | 32.1 | 35.8 | 325 | 35 | 1.15 | 16 | 10.8 | 6.5 | 2.18 | 0.06 | 0.25 | 0.05 | 0.98 |
| 5 | 5.8 | 18.1 | 103 | 32.1 | 32.1 | 320 | 35 | 1.15 | 16 | 10.4 | 6.4 | 2.18 | 0.09 | 0.25 | 0.05 | 0.9 |
| 6 | 5.4 | 18.1 | 101 | 32.1 | 30 | 315 | 35 | 1.15 | 16 | 10.2 | 6.3 | 2.18 | 0.12 | 0.25 | 0.05 | 0.8 |
| Comparative Example | | | | | | | | | | | | | | | | |
| 1 | 9 | 18.1 | 43.2 | 32.1 | 50 | 134 | 7 | 1.15 | 16 | 9.4 | 2.7 | 0.43 | 0.12 | 0.25 | 0.05 | 0.22 |
| 2 | 9.2 | 18.1 | 38.9 | 32.1 | 50 | 121 | 5 | 1.15 | 16 | 9.5 | 2.43 | 0.31 | 0.12 | 0.25 | 0.05 | 0.2 |

TABLE 1-continued

| | Ac ($mm^2$) | At ($mm^2$) | P (mm) | L (mm) | Ac/At (%) | P/L (%) | N (number) | H (mm) | W (mm) | Q (kW) | P/W | N/W | Ta (mm) | Tb (mm) | R (mm) | ha (kW/K) |
|---|---|---|---|---|---|---|---|---|---|---|---|---|---|---|---|---|
| 3 | 7.4 | 18.1 | 108 | 32.1 | 41 | 336 | 35 | 1.15 | 16 | 10.6 | 6.75 | 2.18 | 0.03 | 0.25 | 0.05 | — |
| 4 | 4.31 | 18.1 | 98.4 | 32.1 | 23 | 307 | 35 | 1.15 | 16 | 9.65 | 6.15 | 2.18 | 0.17 | 0.25 | 0.05 | — |

Ac: Total cross-sectional area of the refrigerant flow passages
At: Total cross-sectional area of the tube main body
P: Total interior peripheral length of the refrigerant flow passages
L: Exterior peripheral length of the tube main body
N: Number of refrigerant flow passages
H: Height of tube main body
W: Width of tube main body
Ta: Thickness of the partition wall
Tb: Thickness of the external peripheral wall
R: Curvature radius of the corner portion of the refrigerant flow passage
Q: Heat transfer quantity (kW)
ha: Heat transfer rate (kW/K)

Example 1

As shown in Table 1, a heat exchanger tube in which the total cross-sectional area of the refrigerant flow passages Ac was 6.5 $mm^2$, the total cross-sectional area of the tube main body was 18.1 $mm^2$, Ac/At was 35.8%, P/L was 325%, the total interior peripheral length of the refrigerant flow passages P was 104 mm, the external peripheral length of the tube main body was 32.1 mm, the number of refrigerant flow passages was 35, the tube main body height H was 1.15 mm, the tube main body width W was 16 mm, the partition wall thickness Ta was 0.06 mm, the thickness of the external peripheral wall Tb was 0.25 mm and the curvature radius R of the refrigerant flow passage was 0.05 mm, was prepared.

Figure 16:
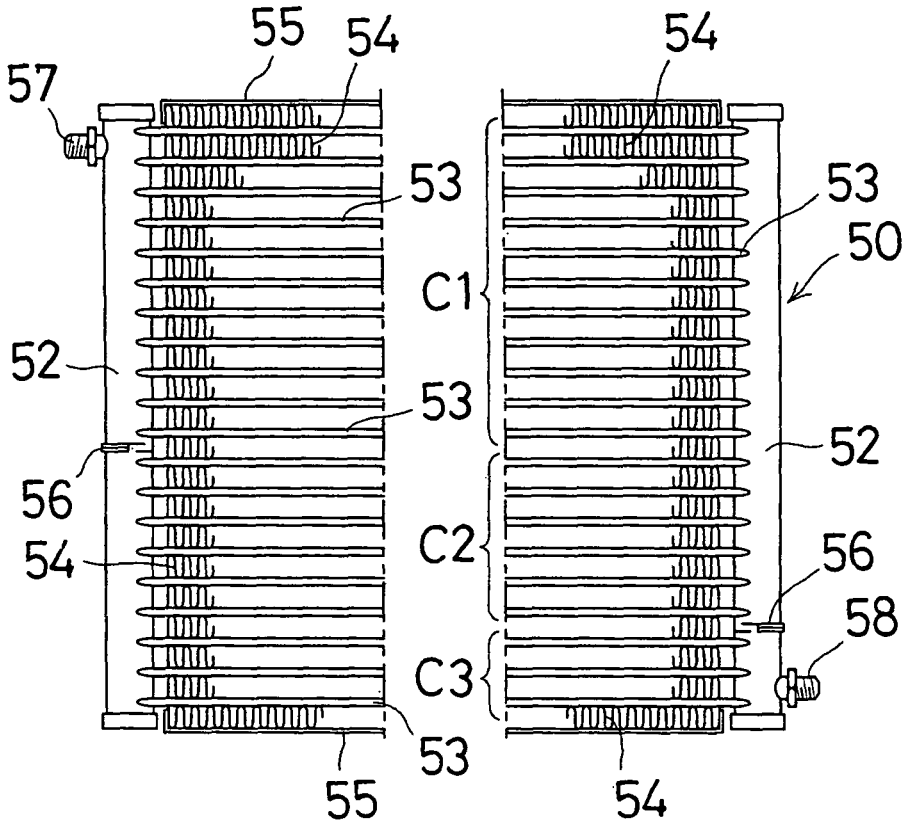
FIG. 16 is a front view showing the condenser for a car air-conditioner.
Figure 17:
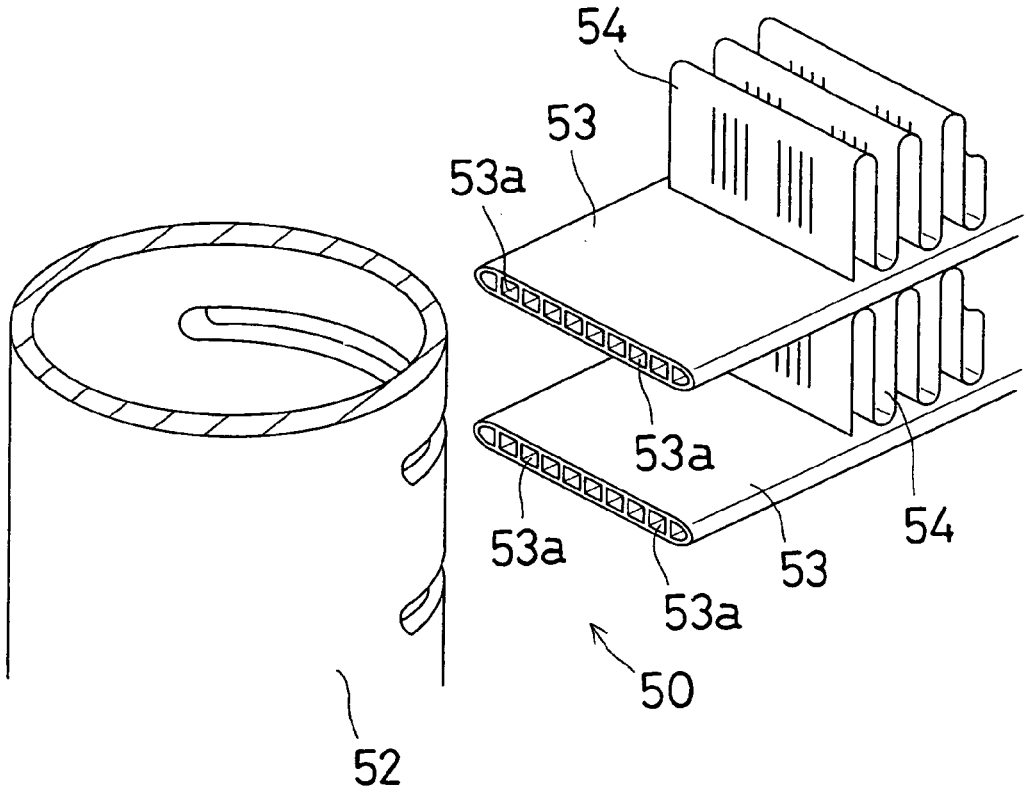
FIG. 17 is an exploded perspective view showing the principle portion of the condenser for a car air-conditioner.

A multi-flow type condenser shown in FIGS. 16 and 17 was formed by using the heat exchanger tubes, and the heat performance Q and the heat transfer ha were measured.

Examples 2-11

Comparative Examples 1-7

In the same manner as in the aforementioned Example, Condensers were formed by using the heat exchangers shown in Tables 1 and 2, and measurements were performed in the same manner.

As shown in Tables 1 and 2, in the heat exchanger related to the present invention, they are excellent in heat transfer and in heat performance.

<Evaluation of Heat Performance>

Figure 14:
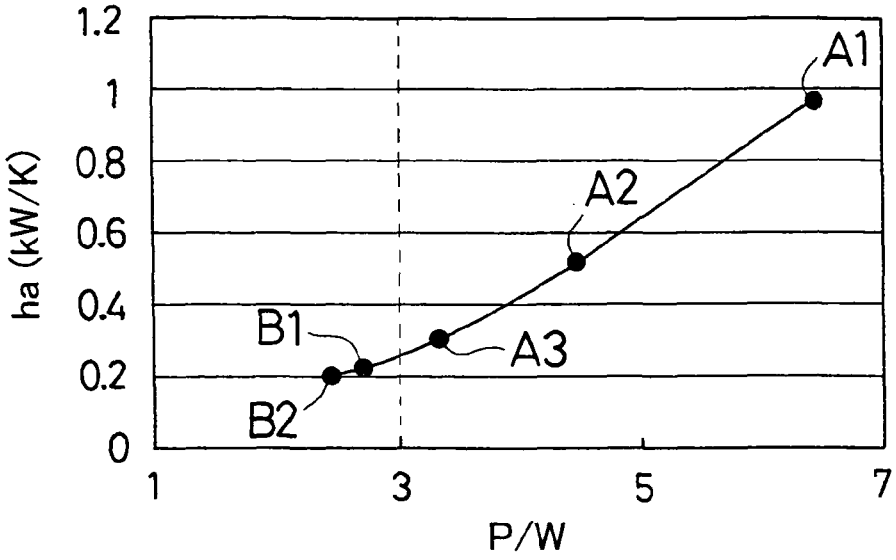
FIG. 14 is a graph showing the relation between the heat transfer and P/W in the heat exchanger tube of the example and comparative example.

In each condenser of the aforementioned Examples 1-3 and Comparative Examples 1 and 2, the relation between P/W and the heat transfer ha is shown in the graph shown in FIG. 14. In the graph shown in FIG. 14, Examples 1-3 are shown by A1 to A3, and Comparative Examples 1 and 2 are shown by B1 and B2, respectively.

TABLE 2

| | Ac ($mm^2$) | At ($mm^2$) | P (mm) | L (mm) | Ac/At (%) | P/L (%) | N (number) | H (mm) | W (mm) | Q (kW) | P/W | N/W | Ta (mm) | Tb (mm) | R (mm) | ha (kW/K) |
|---|---|---|---|---|---|---|---|---|---|---|---|---|---|---|---|---|
| Example | | | | | | | | | | | | | | | | |
| 7 | 8 | 18.1 | 71 | 32.1 | 44.2 | 223 | 20 | 1.15 | 16 | 10.1 | 4.46 | 1.25 | 0.06 | 0.25 | 0.05 | 0.52 |
| 8 | 8.8 | 18.1 | 53 | 32.1 | 48.6 | 166 | 12 | 1.15 | 16 | 10 | 3.32 | 0.75 | 0.06 | 0.25 | 0.05 | 0.3 |
| 9 | 6.5 | 18.1 | 104 | 32.1 | 35.8 | 325 | 35 | 1.15 | 16 | 10.8 | 6.5 | 2.18 | 0.06 | 0.25 | 0.05 | 0.98 |
| 10 | 5.8 | 18.1 | 103 | 32.1 | 32.1 | 320 | 35 | 1.15 | 16 | 10.4 | 6.4 | 2.18 | 0.09 | 0.25 | 0.05 | 0.9 |
| 11 | 5.4 | 18.1 | 101 | 32.1 | 30 | 315 | 35 | 1.15 | 16 | 10.2 | 6.3 | 2.18 | 0.12 | 0.25 | 0.05 | 0.8 |
| Comparative Example | | | | | | | | | | | | | | | | |
| 5 | 9.2 | 18.1 | 38.9 | 32.1 | 50 | 121 | 5 | 1.15 | 16 | 9.5 | 2.43 | 0.31 | 0.12 | 0.25 | 0.05 | 0.2 |
| 6 | 11.1 | 18.1 | 80.6 | 32.1 | 61 | 251 | 20 | 1.15 | 16 | 9.75 | 5.04 | 1.25 | 0.07 | 0.18 | 0.05 | — |
| 7 | 4.31 | 18.1 | 98.4 | 32.1 | 23 | 307 | 35 | 1.15 | 16 | 9.65 | 6.15 | 2.18 | 0.17 | 0.25 | 0.05 | — |

Ac: Total cross-sectional area of the refrigerant flow passages
At: Total cross-sectional area of the tube main body
P: Total interior peripheral length of the refrigerant flow passages
L: Exterior peripheral length of the tube main body
N: Number of refrigerant, flow passages
H: Height of tube main body
W: Width of tube main body
Ta: thickness of the partition wall
Tb: Thickness of the external peripheral wall
R: Curvature radius of the corner portion of the refrigerant flow passage
Q: Heat transfer quantity (kW)
ha: Heat transfer rate (kW/K)

<Evaluation of Pressure Resistance>

Inner pressure was applied to each condenser of Examples 4-6 and Comparative Examples 3 and 4, and the burst pressure [MPa] was measured. In each heat exchanger tube, the aforementioned measurement was performed in the state in which zinc diffusion layer (sacrifice corrosion layer) was removed.

Figure 15:
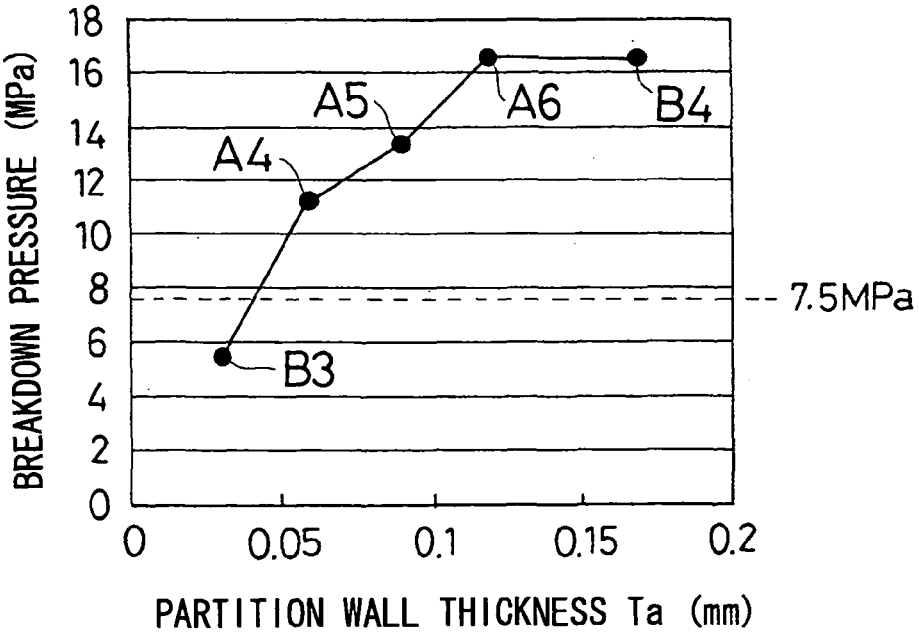
FIG. 15 is a graph showing the relation between the breakdown pressure and the partition wall thickness in the heat exchanger tube of the example and comparative example.

The measured results were shown in the graph in FIG. 15 and Table 3 shown below. In the graph in FIG. 15, Examples 4-6 are shown by A4-A6, respectively, and Comparative Examples 4 and 5 are shown by B4 and B5, respectively.

TABLE 3

| | Ta [mm] | Burst pressure [MPa] |
|---|---|---|
| Example 4 | 0.06 | 11.3 |
| Example 5 | 0.09 | 13.5 |
| Example 6 | 0.12 | 16.5 |
| Comparative Example 3 | 0.03 | 5.4 |
| Comparative Example 4 | 0.17 | 16.5 |

This application claims priority to Japanese Patent Application No. 2000-356968 filed on Nov. 24, 2000, the disclosure of which is incorporated by reference in its entirety.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

INDUSTRIAL APPLICABILITY

As mentioned above, according to the heat exchanger tube of the present invention and the heat exchanger using the tubes, it is possible to reduce the weight and improve the heat exchanging performance. Therefore, they are preferably used for a refrigeration system especially as a car air-conditioning refrigeration system.

The invention claimed is:

1. A heat exchanger tube provided with a flat tube main body with a certain length and having a plurality of refrigerant flow passages each extending in a tube longitudinal direction and disposed in parallel in a tube widthwise direction, wherein the following relations are established:

$Ac/At \times 100 = 30$ to 45; and $P/L \times 100 = 200$ to 325, wherein a total cross-sectional area of the tube main body (including the refrigerant passage portions) is "At"; a total cross-sectional area of the refrigerant flow passages is "Ac"; an external peripheral length of the tube main body is "L"; and a total internal peripheral length of the refrigerant passages is "P", wherein the relation of H=0.5 to 1.5 mm is established, wherein a height of the tube main body is "H", and wherein the relation of W=10 to 20 mm is established, wherein a width of the tube main body is "W".

2. The heat exchanger tube as recited in claim 1, wherein $Ac/At \times 100$ is set to be 35 or more but 40 or less and $P/L \times 100$ is 250 or more.

3. The heat exchanger tube as recited in claim 1, wherein the relation of $5/8 < N/W$ is established, wherein the number of the refrigerant flow passages is "N" and a width of the tube is "W".

4. The heat exchanger tube as recited in claim 1, wherein the relation of $Tb \times 1/8 < Ta < Tb \times 2/3$ is established, wherein a thickness of a partition wall between the adjacent refrigerant flow passages in the tube main body is "Ta"; and a thickness of an external peripheral wall of the tube main body "Tb".

5. A heat exchanger including a pair of headers disposed in parallel and a plurality of flat tubes with opposite ends thereof communicated with the headers, wherein refrigerant introduced via a refrigerant inlet of the header passes through the flat tubes while exchanging heat and flows out of a refrigerant outlet of the header, wherein the flat tube has a flat tube main body having a predetermined length and a plurality of refrigerant passages each extending in a tube longitudinal direction and arranged in parallel in a tube widthwise direction, and wherein the relations of $Ac/At \times 100 = 30$ to 45 and $P/L \times 100 = 200$ to 325 are established, wherein a total cross-sectional area of the tube main body (including the refrigerant flow passages) is "At"; a total cross-sectional area of the refrigerant flow passages is "Ac"; an external peripheral length of the tube main body is "L"; and a total peripheral length of the refrigerant flow passages is "P", wherein the relation of H=0.5 to 1.5 mm is established, wherein a height of the tube main body is "H", and wherein the relation of W=10 to 20 mm is established, wherein a width of the tube main body is "W".

* * * * *